United States Patent [19]

Kartman et al.

[11] 4,155,511

[45] May 22, 1979

[54] ROLLER MILL

[75] Inventors: Helge C. C. Kartman; Jørgen Vorup, both of Copenhagen-Valby, Denmark

[73] Assignee: F. L. Smidth, Cresskill, N.J.

[21] Appl. No.: 795,803

[22] Filed: May 11, 1977

[30] Foreign Application Priority Data

May 12, 1976 [GB] United Kingdom ..... 19478/76

[51] Int. Cl.[2] ..... B02C 15/00

[52] U.S. Cl. ..... 241/117

[58] Field of Search ..... 241/117, 118, 119, 120, 241/121

[56] References Cited

U.S. PATENT DOCUMENTS

| | | | |
|---|---|---|---|
| 495,235 | 4/1893 | Vaughn | 241/117 |
| 835,104 | 11/1906 | Elspass | 241/119 |
| 936,079 | 10/1909 | Best | 241/118 |
| 1,054,011 | 2/1913 | Markle et al. | 241/117 |
| 2,875,959 | 3/1959 | Calkins | 241/119 |
| 3,656,695 | 4/1972 | Bacharach | 241/117 |
| 3,822,829 | 7/1974 | Brundiek et al. | 241/117 |
| 3,951,347 | 4/1976 | Tiggesbaumker et al. | 241/119 |

*Primary Examiner*—Howard N. Goldberg
*Attorney, Agent, or Firm*—Pennie & Edmonds

[57] ABSTRACT

A vertical roller mill resting on a mill foundation is disclosed in which a rotatable grinding table having an endless grinding path is driven by a driving mechanism located beneath the grinding table and in which the grinding table rotates on bearing means which are mounted on generally vertical support means, the support means positioned beneath the grinding path of the grinding table to support the grinding table and to transmit grinding pressures and vibrations from the grinding table downward directly to the mill foundation while substantially avoiding transmission of the pressures and the vibrations to said driving mechanism.

9 Claims, 5 Drawing Figures

ROLLER MILL

BACKGROUND OF THE INVENTION

1. Field of the Invention

The invention relates to support means for a horizontally rotating grinding table in a roller mill of the vertical type in which the grinding table is driven by a driving mechanism located in the mill beneath the grinding table.

2. Description of the Prior Art

To ensure stability in known mill constructions of this type, the grinding table has previously been supported on the housing of the driving mechanism proper or on a central support in conjunction with the driving mechanism. In such constructions, grinding pressure and the often very severe vibrations which may arise when grinding material between grinding rollers and the grinding path on the grinding table, have been transmitted directly to the driving mechanism and hence to the mill foundation. Consequently, the vibrations inevitably caused a great strain on parts of the driving mechanism causing those parts to wear out faster and thereby reduce the total economy of the mill.

It is an object of this invention to devise a support for a grinding table in a vertical roller mill, in which stability and the compact form of the mill are important considerations, and the above disadvantages are simultaneously eliminated.

SUMMARY OF THE INVENTION

According to the invention, a vertical roller mill supported on a mill foundation comprises a rotatable grinding table having an endless grinding path, drive means positioned substantially beneath said grinding table for rotation thereof, means positioned substantially beneath said grinding path of said grinding table for supporting said grinding table and for transmitting grinding pressures and vibrations from the grinding table downwardly to the base support while substantially avoiding transmission of the grinding pressures and vibrations to the drive means, and bearing means positioned on said support means and disposed between said support means and said grinding table to facilitate rotation of said grinding table.

Preferably, the slide shoe bearings, of which there must be at least three, and on which the grinding table rests, are located at equiangularly spaced intervals.

It may be advantageous to mount the slide shoe bearings on the top of the support means such as an upright support by means of part spherical bearings. This would reduce the impact of the twisting and turning forces of the movable mill parts on the upright support. Further, the bearing means such as slide shoe bearings may be provided with chambers for a cooling agent for internal cooling of the slide shoes during operation. Lubrication of the slide surfaces of the slide shoes may take place in a known manner by special pressure lubrication systems or by dip lubrication.

The upright support for the grinding table may be composed of a hollow cylindrical wall, of circular or polygonal cross section. The vertical pressure on the grinding table applied by the grinding rollers will then be transmitted substantially directly downward. Since the grinding path which is preferably circular will be positioned adjacent to the periphery of the grinding table, the cylindrical wall will have a cross-section similar to that of the grinding table.

There may be at least one opening in the cylindrical wall to provide access to the driving mechanism so that the driving mechanism beneath the grinding table may be readily inspected. The opening is preferably arched so that forces exerted by the other parts of the mill, especially by the grinding table, the grinding rollers, and the pressure of the rollers on the grinding table, and acting on the support, may be absorbed by the arch construction and from this be distributed to the more rigid parts of the support.

The cylindrical wall may have more than one opening which, if convenient, may be enlarged to such an extent that the cylindrical wall is discontinuous so that it consists essentially of a ring of supporting columns on which the slide shoe bearings are mounted.

The new mill construction has the advantage of prolonging the useful life of the drive mechanism, since mill operation vibrations are only to a very slight extent transmitted to the driving mechanism. The location of the mechanism is maintained beneath the grinding table while the possibilities for inspecting the mechanism are improved, even during mill operation, particularly when an arched opening is provided for access to the mechanism.

For further relief of the undesirable power impacts from the grinding parts of the driving mechanism, a centrally located driving shaft, located between a gear located beneath the grinding table and the table proper, may be equipped with a flexible clutch. For stability, such a driving shaft may be controlled at its top by a spherical roller bearing, retained in position by ribs radially mounted at the top of the support of the grinding table.

BRIEF DESCRIPTION OF THE DRAWINGS

The invention will be explained with reference to a preferred embodiment illustrated in the accompanying drawings, wherein.

DETAILED DESCRIPTION OF THE PREFERRED EMBODIMENT

Figure 1:
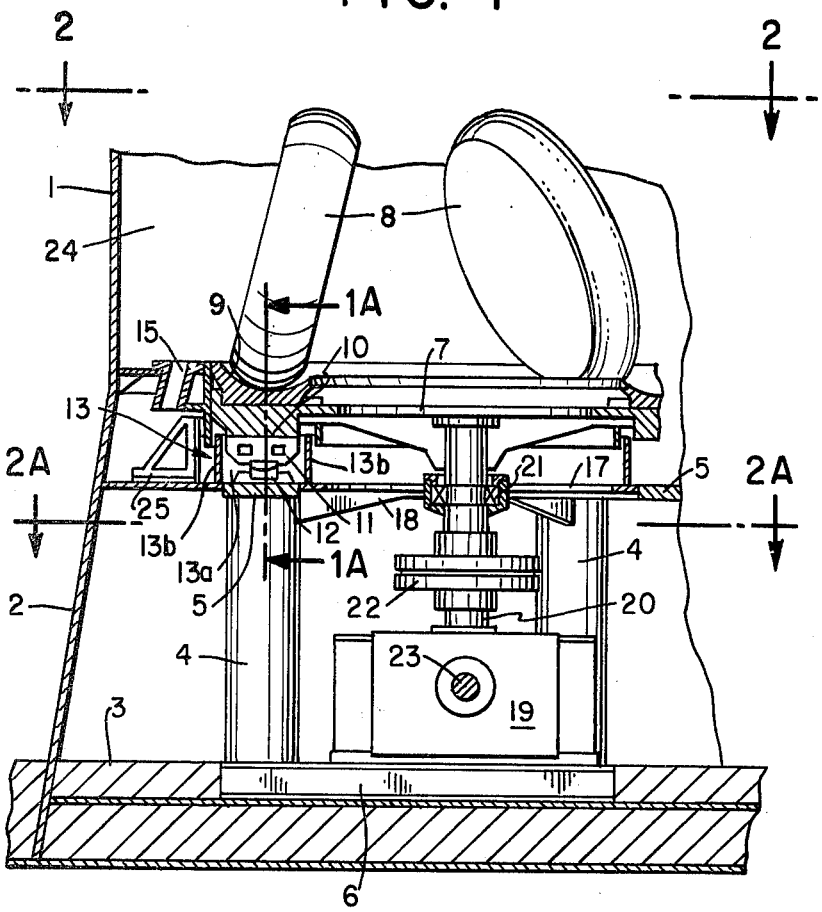
FIG. 1 is a partial side elevation, partially in axial cross-section of a vertical roller mill showing one grinding roller.

The illustrated vertical roller mill has a housing 1, which has at its bottom a base 2 resting on the mill foundation 3. A horizontally rotating grinding table 7 is mounted on three upright vertical support members 4 by means of slide shoe bearings 13 illustrated in detail in FIGS. 1 and 1A. The downwardly facing surface of the grinding table rests on slide shoe bearings 13, and travels along a circular slide path 10 substantially directly below a grinding path 9 on the upwardly facing surface of the table. The bearings 13 include slide shoes 11 which, by spherical bearings 12, rest on support members 4. The support members 4 may, for example, be made out of metal or concrete. The support members 4 may be limited to three cylinder wall sections or three vertical support columns, each of which is positioned beneath, and supports one of the slide shoe bearings, as shown clearly in FIGS. 1 and 1A. Depending upon needs or materials available, vertical support members 4 may be constructed of materials such as metal, concrete (as illustrated, for example, in FIG. 1B), and the like. Alternately, support may be provided by sections of a vertical cylindrical wall whose diameter corresponds essentially to that of the grinding table or it may be provided by sections of a hexagonal wall having dimensions which correspond generally to the dimensions of the grinding table. The support members 4 are bounded, at their top, by an annular top plate 5, and at their bottom, in the preferred embodiment by an annular or generally triangular bottom plate 6.

The support members 4, especially where they support a slide shoe bearing directly, may be equipped with stiffeners between the top and bottom plate.

Figure 2:
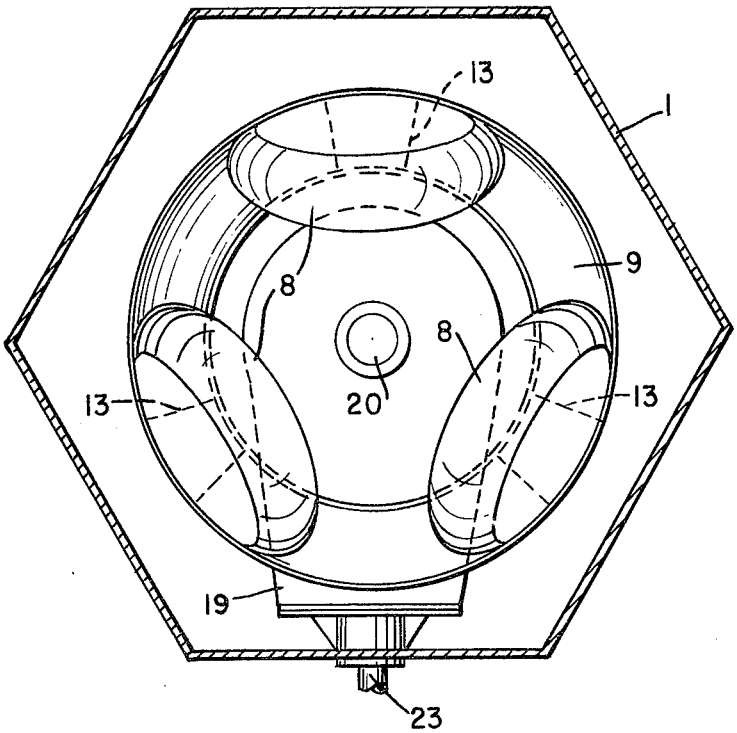
FIG. 2 is a partial cross-sectional view taken in the direction of lines 2—2 of FIG. 1.
Figure 2A:
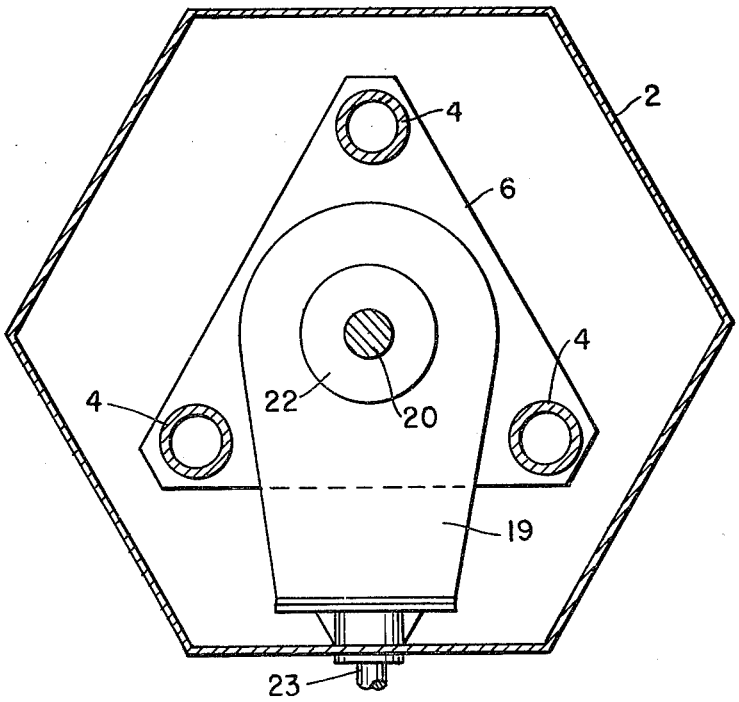
FIG. 2A is a view, partially in cross-section, taken in the direction of lines 2A—2A of FIG. 1.

To facilitate providing a driving mechanism beneath the grinding table, and to facilitate its inspection and maintenance, access may be provided by the space between the three support members 4. In the example shown, such a driving mechanism is constituted by a gear box 19 which is connected to a motor (not shown) by a shaft 23. From the gear box, the grinding table 7 is driven by means of a drive shaft 20 which is connected to a flexible clutch 22. For stability, the drive shaft may be controlled by a spherical roller bearing 21 which is retained in position by ribs 17 and radial stiffeners 18 which are located inside the support 4 at a top portion thereof. As shown in FIG. 2, the grinding table rests on three slide shoe bearings 13 shown in dotted lines; however, it should be understood that any suitable number of slide shoe bearings may be used for this purpose.

Figure 1A:
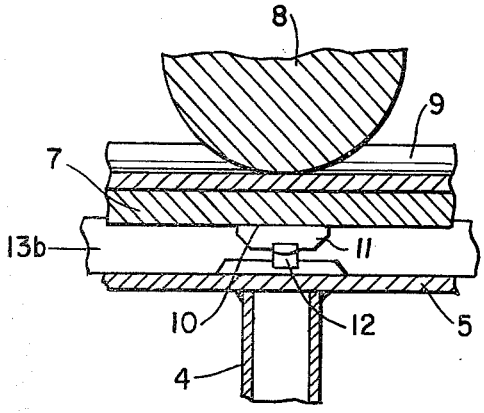
FIG. 1A is a fragmentary view, partially in cross-section, taken in the direction of lines 1A—1A of FIG. 1.
Figure 1B:
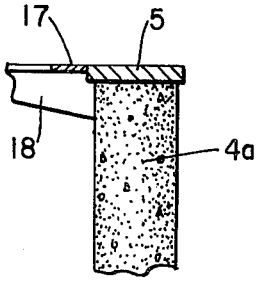
FIG. 1B is a fragmentary view, partially in cross-section, of an alternate embodiment of the invention.

The grinding rollers 8 are suspended in a pressure frame of known construction (not shown), or in a likewise known mechanism in the grinding chamber 24. For clarity, only one grinding roller is shown in FIGS. 1 and 2. In the transition plane between the house 1 and the base 2, the mill, in a known manner, may have air intakes 15 for the grinding chamber, and be further provided with a scraper mechanism 25 located beneath the air intake for removal of waste from the grinding chamber.

As shown in FIG. 1, for instance, the slide shoe bearings 13 may be provided with chambers between side plates **13*b* as shown, 13*a* for retention of a cooling agent. A lubricating fluid may be utilized in slide path 10 to facilitate rotatable sliding motion of grinding table 7**.

By using spherical bearings 12 for mounting the slide shoes on the support 4, the impacts of the twisting and turning forces of movable mill components are reduced further. Further, by using the flexible clutch 22 on the drive shaft 20 between the grinding table 7 and the gear box 19, impacts of the movable mill parts on the stationary mill parts and on the driving mechanism in the form of twisting and turning forces are further reduced.

We claim:

1. An upright roller mill supported on a mill foundation which comprises:

(a) a frame having an upper housing portion and a lower base portion, said frame positioned on the mill foundation;

(b) a horizontally rotatable grinding table disposed in said frame and having a generally endless grinding path having a generally concave cross sectional configuration on the upper side thereof for grinding materials;

(c) drive means positioned generally centrally beneath said grinding table for rotation thereof;

(d) at least three upright vertical support members positioned generally beneath the grinding path of said grinding table and approximately equally spaced from each other for supporting said grinding table and for transmitting grinding pressures and vibrations from said grinding table downward directly to the foundation while substantially avoiding transmission of the pressures and the vibrations to said drive means;

(e) individual arcuate bearing means mounted at the top of each upright support member; and (f) slide shoe bearing means fixedly mounted on each of said individual arcuate bearing means, each slide shoe bearing means defining an upper slide surface positioned generally beneath the grinding path of said grinding table and in contacting relation with the underside thereof for slidably rotatably supporting said grinding table such that said slide shoe bearing means and arcuate bearing means cooperate to permit flexing of said grinding table during rotation thereof.

2. A vertical roller mill according to claim 1 wherein said vertical upright support members are constructed of a metal material.

3. A vertical roller mill according to claim 1 wherein said vertical upright support members are constructed of concrete.

4. A vertical roller mill according to claim 1 which further comprises an annular top plate positioned top of said upright support members and supporting said arcuate bearing means and an annular bottom plate positioned on the mill foundation below said upright support members.

5. A vertical roller mill according to claim 4 wherein said upper housing portion of said frame defines a grinding chamber which has at least one opening communicating with said lower base portion of said frame for the passage of air therethrough.

6. A vertical roller mill according to claim 5 wherein each of said upright support members is columnar.

7. A vertical roller mill according to claim 6 wherein each of said vertical support columns is equidistantly positioned about the circumference of a circle whose diameter is approximately equal to the diameter of the grinding path of said grinding table.

8. A vertical roller mill resting on a mill foundation which comprises:

(a) a frame having an upper housing portion defining a grinding chamber, a lower base portion supporting said housing, said grinding chamber having at least one opening communicating with said lower base portion for ventilation, said frame positioned on and supported by the mill foundation;

(b) a horizontally rotatable grinding table disposed within said frame and having a furrowed circular grinding path in said grinding chamber;

(c) at least one grinding wheel positioned for rotation on said grinding table and positioned at least partially within said grinding path for grinding raw materials between said grinding path and the grinding wheel as said grinding table is rotated;

(d) a driving mechanism positioned generally centrally beneath said grinding table for rotation of said grinding table and supported on said mill foundation, said driving mechanism including a generally centrally located vertical drive shaft, a flexible clutch and spherical roller bearings;

(e) at least three upright vertical support members positioned beneath the grinding path of said grinding table and approximately equally spaced from each other for supporting said grinding table and for transmitting grinding pressures and vibrations from said grinding table directly downward to the mill foundation while substantially avoiding transmission of the pressures and the vibrations to said driving mechanism, said enclosure having at least one arched opening to provide access to said drive mechanism to facilitate inspection and maintenance thereof; and (f) a slide shoe bearing fixedly mounted at the top of each upright support member and having a slide surface for slidably rotatably supporting said grinding table, each slide shoe bearing having a spherical bearing member positioned therein to support said grinding table while permitting twisting and rotational motions due to flexing of mill components.

9. A vertical roller mill supported on a mill foundation which comprises:

(a) a mill frame having an upper hexagonal housing portion defining a grinding chamber, a lower base portion supporting said housing, said grinding chamber having at least one opening communicating with said lower base portion for ventilation, said frame positioned on and supported by the mill foundation;

(b) a horizontally rotatable grinding table disposed within said frame and having a furrowed circular grinding path in said grinding chamber;

(c) at least three grinding wheels positioned for rotation on said grinding table and positioned at least partially within said grinding path for grinding raw materials between said grinding path and said grinding wheels as said grinding table is rotated;

(d) a driving mechanism positioned generally centrally beneath said grinding table for rotation of said grinding table and supported on said mill foundation, said driving mechanism including a centrally located vertical drive shaft, a flexible clutch and spherical roller bearings;

(e) at least three spaced apart vertical columnar support members each of which is positioned generally centrally beneath the grinding path of said grinding table and approximately equally spaced from each other to support said grinding table and to transmit grinding pressures and vibrations from said grinding table directly downward to the mill foundation while substantially avoiding transmission of the pressures and the vibrations to said driving mechanism; and (f) at least three slide shoe bearings, each bearing being mounted at the top of each of said vertical columnar support members and disposed between the respective vertical columnar support member and the grinding table and having a slide surface beneath the grinding path for rotatably supporting said grinding table, each slide shoe bearing having a spherical bearing member positioned therein to support said grinding table while permitting twisting and rotational motion due to flexing of movable mill components.

* * * * *